United States Patent [19]

Mokiao, II

[11] Patent Number: 4,949,842

[45] Date of Patent: Aug. 21, 1990

[54] WETSUIT CARRIER

[76] Inventor: Charles Mokiao, II, 4892 Dixie St., San Diego, Calif. 92109

[21] Appl. No.: 431,991

[22] Filed: Nov. 6, 1989

[51] Int. Cl.[5] ..... B65D 85/18

[52] U.S. Cl. ..... 206/286; 206/287; 206/278; 383/103; 383/117

[58] Field of Search ..... 206/278, 284, 285, 286, 206/287, 289, 290, 291; 383/67, 103, 117

[56] References Cited

U.S. PATENT DOCUMENTS

| | | | |
|---|---|---|---|
| 2,324,072 | 7/1943 | Frost | 206/387 |
| 2,602,482 | 7/1952 | Lyon | 383/117 |
| 2,739,755 | 3/1956 | Ottinger | 383/117 |
| 2,935,182 | 5/1960 | Cater | 206/387 |
| 3,264,755 | 8/1966 | Moore | 206/387 |
| 3,276,601 | 10/1966 | Haggerty | 206/287 |
| 3,557,944 | 1/1971 | Crane | 206/287 |
| 4,753,342 | 6/1988 | Pulichino | 206/291 |

FOREIGN PATENT DOCUMENTS

| | | | |
|---|---|---|---|
| 1288052 | 1/1969 | Fed. Rep. of Germany | 206/287 |
| 2256660 | 7/1975 | France | 383/103 |

*Primary Examiner*—David T. Fidei

*Attorney, Agent, or Firm*—Henri J. A. Charmasson

[57] ABSTRACT

A garment bag specifically designed for handling a diver's wetsuit which has a mid-section made from netting material and a waterproof bottom acting as a drainable drip-pan. The wetsuit can be suspended on a hanger within the bag for drying and/or storage. The drip-pan can be drained by means of a resealable outlet. A hook at the top of the bag allows it to be hung during transportation or storage as a conventional garment bag, whether or not the wetsuit is in a wet or dry condition.

9 Claims, 1 Drawing Sheet

FIG 1
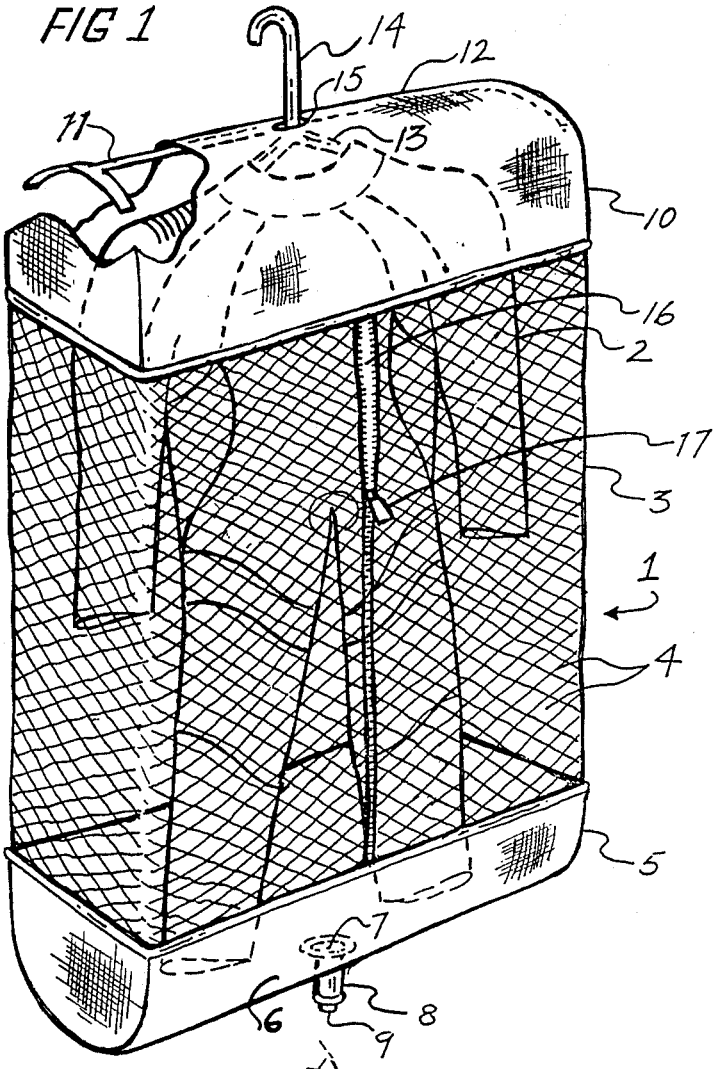
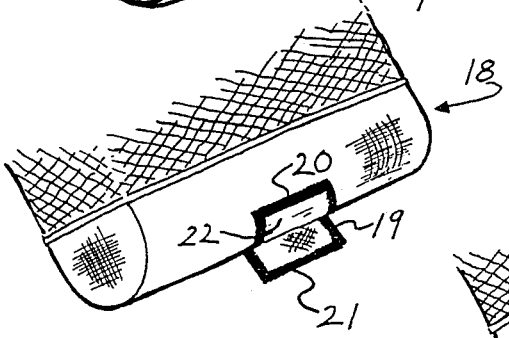
FIG 2
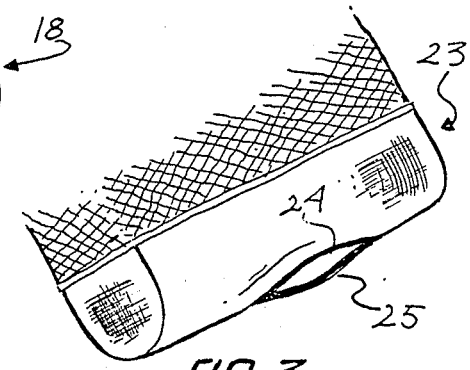
FIG 3

WETSUIT CARRIER

BACKGROUND OF THE INVENTION

This invention relates to luggage, and more specifically garment bags. Divers and surfers use wetsuits made from rubber and synthetic foams which, do to their bulk and wet state, are difficult to handle, transport and store. Yet, it is very important that a wetsuit be allowed time to thoroughly dry before being folded and put away in order to avoid mildewing. After a dive or a surfing session wet suits are seldom allowed to dry before they have to be transported or stored. Water sport enthusiasts use waterproof bags or tubs to carry their wetsuits in the backseat of a car or in its trunk then hang them to dry once they reach home. The wetsuits are sometimes forgotten in their waterproof containers for several days during which they become subject to mildew and other deteriorating process. When hung to dry, the wetsuit must be kept in a well-ventilated area sheltered from harmful sun rays. Shower stalls and bathtubs are about the only convenient places where wetsuits can be hung for drying without the dripping water causing damage to the floor underneath.

There is an acute need for a device that would free divers and surfers from the risk of damaging their wetsuits by letting them dry in a confined location and would allow the wetsuits to be hung up to dry in a less encumbering way than hanging them in shower stalls or over a bathtub.

SUMMARY OF THE INVENTION

The principal and secondary objects of this invention are to provide a garment bag specifically engineered to allow the storage and controlled drying of a diver's wetsuit in any convenient place without dripping water on the floor underneath.

These and other objects are achieved by a garment bag having a mid-section made from a synthetic netting material and having a bottom made from waterproof pliable laminar material which acts as a drainable drip-pan.

BRIEF DESCRIPTION OF THE DRAWINGS

FIG. 1 is a perspective view of the preferred embodiment of the invention with a cutout showing the internal structure;

FIG. 2 is a partial perspective view of an alternate embodiment of the carrier draining aperture; and FIG. 3 is a second alternate embodiment of the drainage aperture.

DESCRIPTION OF THE PREFERRED EMBODIMENT OF THE INVENTION

Referring now to the drawing, there is shown in FIG. 1 the preferred embodiment of the invention 1 in combination with a wetsuit 2. The wetsuit carrier 1 has the general configuration of a garment bag, except that the mid-section 3 has apertures 4 scattered therethrough. Typically, the mid-section 3 is a length of netting made from an imputrescible material such as nylon. The mid-section 3 surrounds the major part of the wetsuit 2. The bottom edge is permanently bonded to a trough-shaped bottom section 5 which is made from a waterproof material also imputrescible. Typically, the bottom section 5 can be made from a vinyl-coated nylon fabric. An aperture 6 in the lowest portion of the bottom section 5 allows the draining of water which may have dripped from the wetsuit, through a section of hose 8 sealed by a plug 9.

The upper edge of the mid-section 3 is bonded to the bottom edges of a top section 10 which therefore caps the mid-section 3. A rigid member 11 spans the roof 12 of the top section maintaining it in a generally horizontal position. The top section 10 is preferably made from the same waterproof material used in the fabrication of the bottom section 5 although water-tightness is not required. The wetsuit 2 is suspended by a clothes hanger with a hook 14 having it shank passing through an aperture 15 in the roof 12 of the top section 10.

Access to the carrier is provided through a slot 16 which is closed by a slide fastener 17.

An alternate embodiment 18 of the bottom section is illustrated in FIG. 2. The drain hole, is replaced by a flap of material 19 which has been cut along three of its sides from the lowest part of the drip-pan. Mating strips 20 and 21 of hook-and-vane cloth fasteners are bonded to the edges of the aperture 22 and flap 21 to provide a seal.

FIG. 3 illustrates a second alternate embodiment 23 of the bottom section in which the draining aperture consists of a slot 24 sealable by means of mating hook-and-vane fasteners 25 or slide fastener.

The rigid member 11 could be replaced by a strip of curved plastic material. The rigid member could also be eliminated altogether, and the top section allowed to rest on the shoulders of the hanger-mounted wetsuit. The hook 14 could be installed permanently in some foldable configuration to the roof 12 of the top section 10, and the hanger could be detachably suspended inside the carrier according to well-known techniques used in garment bags of the prior art.

It can be understood that the wetsuit carrier can be used for carrying a garment in either dry or wet condition without risk of damage to a car seat or underlying surface due to water drippings. More significantly, the aerated rated carrier allows safe drying of the suit in any convenient location preventing mildew and other deterioriating processes which may take place in a confined and watertight container.

While the preferred embodiment of the invention have been described, modification can be made thereto and other embodiments may be devised without departing from the spirit of the invention and the scope of the appended claims.

What is claimed is:

1. In combination with a diver's garment such as a wetsuit, bathing suit or the like, a drying and storage bag which comprise:

a sealable enclosure made of at least one type of pliable laminar material, and shaped and dimensioned to contain said garment in a generally unfolded position;

said enclosure comprising a mid-section surrounding said garment and made of a first pliable material having a plurality of apertures scattered therethrough;

a bottom section made of a second pliable material which is waterproof, said bottom section being shaped and dimensioned to form a drip-pan under the garment;

a top section capping said mid-section and forming a roof above said garment; and means connected to said top section, for hanging said enclosure.

2. The combination of claim 1, wherein said bottom section comprises a means for draining water from said drip-pan.

3. The combination of claim 2, wherein means for draining is a resealable opening at the lowest part of said drip-pan.

4. The combination of claim 3, wherein said resealable opening including a plug.

5. The combination of claim 3, wherein said resealable opening includes a flap of said waterproof material hinged to said opening.

6. The combination of claim 3, wherein said first pliable material is a length of netting.

7. The combination of claim 3, wherein said second pliable material is a vinyl-covered nylon fabric.

8. The combination of claim 6, wherein said means for hanging comprises a clothes hanger having a hook protruding through an aperture in said top section.

9. The combination of claim 8, wherein said top section comprises a rigid member holding a portion of pliable, laminar material in a generally horizontal position when said enclosure is hung by said hook.

* * * * *